US006588596B1

(12) United States Patent
Holmes et al.

(10) Patent No.: US 6,588,596 B1
(45) Date of Patent: Jul. 8, 2003

(54) PRODUCT PACKAGING AND METHOD OF PACKAGING

(75) Inventors: Joan Catherine Holmes, Framingham, MA (US); Robert M. Vuillemenot, Melrose, MA (US)

(73) Assignee: Polaroid Corporation, Waltham, MA (US)

( * ) Notice: Subject to any disclaimer, the term of this patent is extended or adjusted under 35 U.S.C. 154(b) by 0 days.

(21) Appl. No.: 09/633,718

(22) Filed: Aug. 7, 2000

(51) Int. Cl.[7] ..... B65D 25/54

(52) U.S. Cl. ..... 206/778; 206/459.5; 206/232; 206/467

(58) Field of Search ..... 206/776, 778, 206/781, 782, 232, 316.2, 467, 469, 471, 404, 459.5

(56) References Cited

U.S. PATENT DOCUMENTS

| | | | | | |
|---|---|---|---|---|---|
| 1,670,498 | A | * | 5/1928 | Einson | 206/419 |
| 2,033,526 | A | * | 3/1936 | Kinkenon | 229/162 |
| 2,802,565 | A | | 8/1957 | Kabbash | |
| 3,077,981 | A | * | 2/1963 | Gaspard | 206/223 |
| 3,463,309 | A | | 8/1969 | Szostek | |
| 3,567,013 | A | | 3/1971 | Tannenbaum | |
| 4,046,251 | A | | 9/1977 | Bruml | |
| 4,091,927 | A | * | 5/1978 | Lunsford | 206/461 |
| D255,095 | S | | 5/1980 | Scalice | |
| D273,565 | S | | 4/1984 | Driskell et al. | |
| 4,613,038 | A | | 9/1986 | Kirk | |
| 4,666,037 | A | | 5/1987 | Weissman | |
| 4,669,610 | A | | 6/1987 | Lindsey et al. | |
| 4,687,129 | A | | 8/1987 | Cugley | |
| 4,739,353 | A | * | 4/1988 | Heuer et al. | 206/316.2 |
| 4,739,883 | A | * | 4/1988 | Mohs et al. | 206/461 |
| 4,752,003 | A | | 6/1988 | Miller et al. | |
| 4,795,029 | A | | 1/1989 | Campbell | |
| 4,804,984 | A | * | 2/1989 | Heuer et al. | 206/316 |
| 4,805,766 | A | | 2/1989 | Garcia | |
| 4,842,141 | A | * | 6/1989 | Segal | 206/462 |
| 4,842,143 | A | | 6/1989 | McKee, Sr. et al. | |
| 4,848,541 | A | | 7/1989 | Paliotta et al. | |
| D312,782 | S | * | 12/1990 | Arai et al. | D16/200 |
| D328,249 | S | | 7/1992 | Lee | |
| D346,326 | S | * | 4/1994 | Price et al. | D11/131 |
| 5,377,836 | A | | 1/1995 | Eisenbraun | |
| 5,379,886 | A | * | 1/1995 | Bruner et al. | 206/216 |
| D364,803 | S | | 12/1995 | Wada | |
| D365,022 | S | | 12/1995 | Wada | |
| 5,485,919 | A | * | 1/1996 | Samberg et al. | 206/278 |
| 5,579,288 | A | * | 11/1996 | Malloy et al. | 206/18 |
| D376,313 | S | | 12/1996 | Napolitano | |
| 5,582,293 | A | * | 12/1996 | Kay | 206/457 |
| 5,584,387 | A | | 12/1996 | Grant | |
| 5,613,607 | A | | 3/1997 | Kalmanides et al. | |
| 5,755,327 | A | * | 5/1998 | Saltzman et al. | 206/457 |
| 5,775,494 | A | * | 7/1998 | Taplin | 206/308.2 |
| 5,813,523 | A | * | 9/1998 | Gnadt et al. | 206/756 |
| 5,829,593 | A | | 11/1998 | Appleton | |
| 5,875,893 | A | | 3/1999 | Lee et al. | |
| 5,884,456 | A | | 3/1999 | Hansen | |
| 5,950,820 | A | | 9/1999 | Heinze, III | |
| 6,024,219 | A | * | 2/2000 | Froehlich et al. | 206/459.5 |
| 6,039,183 | A | * | 3/2000 | Rudnick et al. | 206/570 |
| 6,039,495 | A | * | 3/2000 | Zimmerman et al. | 206/463 |
| D427,524 | S | * | 7/2000 | Weisz | D9/418 |
| D429,638 | S | * | 8/2000 | Li et al. | D9/415 |
| D436,531 | S | * | 1/2001 | Holmes et al. | D9/415 |
| 6,170,663 | B1 | * | 1/2001 | Glassman | 206/461 |
| 6,173,833 | B1 | * | 1/2001 | Strehlow | 206/216 |
| 6,328,158 | B1 | * | 12/2001 | Bisbal et al. | 206/223 |
| 6,330,945 | B1 | * | 12/2001 | Reimer | 206/461 |

* cited by examiner

*Primary Examiner*—Shian Luong

(57) ABSTRACT

A product is placed in an inner package, which in turn is placed into outer package. The inner and outer packages have overlying transparent or cut-out or window portions overlying the product or portions of the product enabling the product to be viewed without opening or dismantling of the package assembly. Similarly an information sheet is placed in the outer package below the transparent or cut-out or window portion of the outer package enabling the information sheet to be read without opening the package assembly.

5 Claims, 3 Drawing Sheets

PRODUCT PACKAGING AND METHOD OF PACKAGING

CROSS-REFERENCE TO RELATED APPLICATION

The present invention is related to copending U.S. patent application Ser. No. 29/124,811 filed in the United States Patent and Trademark Office on Jun. 13, 2000.

BACKGROUND OF THE INVENTION

The present generally relates to packaging methods and structures; and, in particular, display packages and methods of manufacturing the same.

Numerous containers exist for packaging products and related accessories for display purposes. For example, U.S. Pat. No. 2,802,565 discloses a product display container that includes a cardboard slide insert that assists in removing the product. U.S. Pat. No. 3,463,309 discloses a reusable product package which has a carrier panel and an article-carrying member. The carrier panel is hinged to a transparent cover that in the closed position covers the article-carrying member. The product package is repeatedly reusable by a purchaser lifting and closing the hinged cover. In the closed position, the transparent cover overlies the article carried by the article-carrying member. U.S. Pat. No. 4,046,251 discloses a package having a package holder within a transparent package. U.S. Pat. No. 4,805,766 discloses a package having a first blister portion covered by a second blister portion that is hinged to the first portion so as to provide a package in a package arrangement. U.S. Design Pat. Nos.: 255,095 and 273,565 disclose an inner blister pack being covered by an outer blister pack. U.S. Design Pat. No. 328,249 discloses a product display package which includes an outer cylindrical information card and product holding blister pack which is generally affixed to the front of another blister pack that is generally triangular in shape.

Despite the variety of packages, there, nevertheless, exists desires to improve the display of products and associated accessories as well as facilitate improvements in the manufacture thereof. None of the heretofore known prior art shows two blister packs, one within the other, with the inner pack enclosing an article, and the outer pack having an aperture through which one can view the article and a consumer information sheet.

SUMMARY OF THE INVENTION

In accordance with the present invention, provision is made for a package assembly for holding and viewing an article. The package assembly includes an inner package having a transparent portion for viewing the article, an outer package receiving the inner package and having a transparent portion overlying the transparent portion of the inner package, and an information sheet in the outer package positioned and dimensioned to expose the article through said transparent portions.

In an illustrated embodiment of the foregoing package assembly, the information sheet has an aperture generally aligned with said transparent portions. In addition, the information sheet is configured to lie against at least one of opposite side walls of the outer package.

In accordance with the present invention, a product is placed in an inner package which in turn is placed into another package. The inner and outer packages have overlying transparent or cut-out or window portions overlying the product or portions of the product enabling the product to be viewed without opening or dismantling of the package assembly. Similarly an information sheet is placed in the outer package below the transparent or cut-out or window portion of the out package enabling the information sheet to be read without opening the package assembly.

Another aspect of the present invention relates to the provision of a method of packaging an article. The method comprises the steps of inserting the article in an inner package having a transparent portion overlying the article, inserting the inner package with the article therein into an outer package having a first transparent portion overlying the transparent portion of the inner package to expose the article to view, inserting an information sheet in the outer package in relationship to a second transparent portion of the outer package, and positioning the information sheet in the outer package spaced from the first transparent portion of the outer package to enable the article to be viewed through the transparent portions of the inner and outer packages.

OBJECT OF THE INVENTION

An object of the present invention is to provide novel and improved product-packaging methods and structures.

A further object of the present intention is to provide a novel package assembly for consumer products although the invention need not be limited to consumer products.

Another object of the present invention is to provided a novel package assembly for a product which package assembly will protect the product while exposing it to view to a consumer or purchase for example who does not have to open the package assembly to view the product.

A further object of the present invention is to provide such a package assembly that exposes to view an information sheet as well as the product thereby avoiding the necessity of opening the package assembly.

A still further object of the present invention is to provide such a product package assembly that includes identical parts and can be economically manufactured with commercially available process.

DETAILED DESCRIPTION

Figure 1:
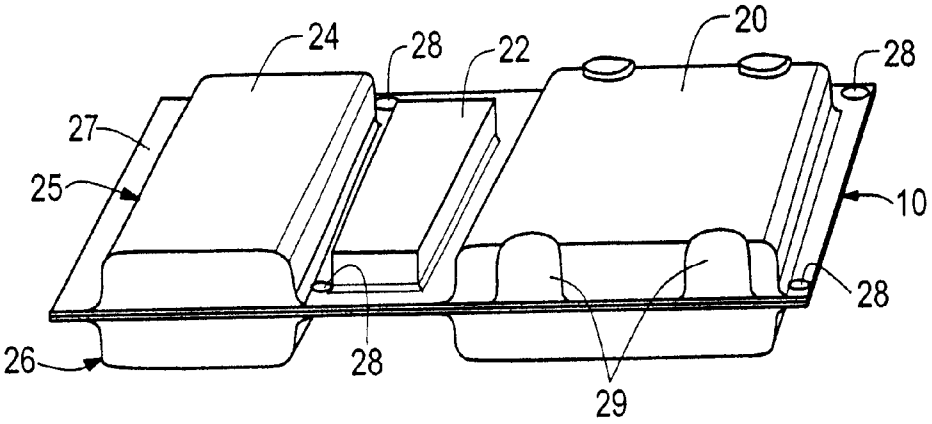
FIG. 1 is a perspective view of an inner package included in a preferred embodiment of the package assembly of the present invention.
Figure 2:
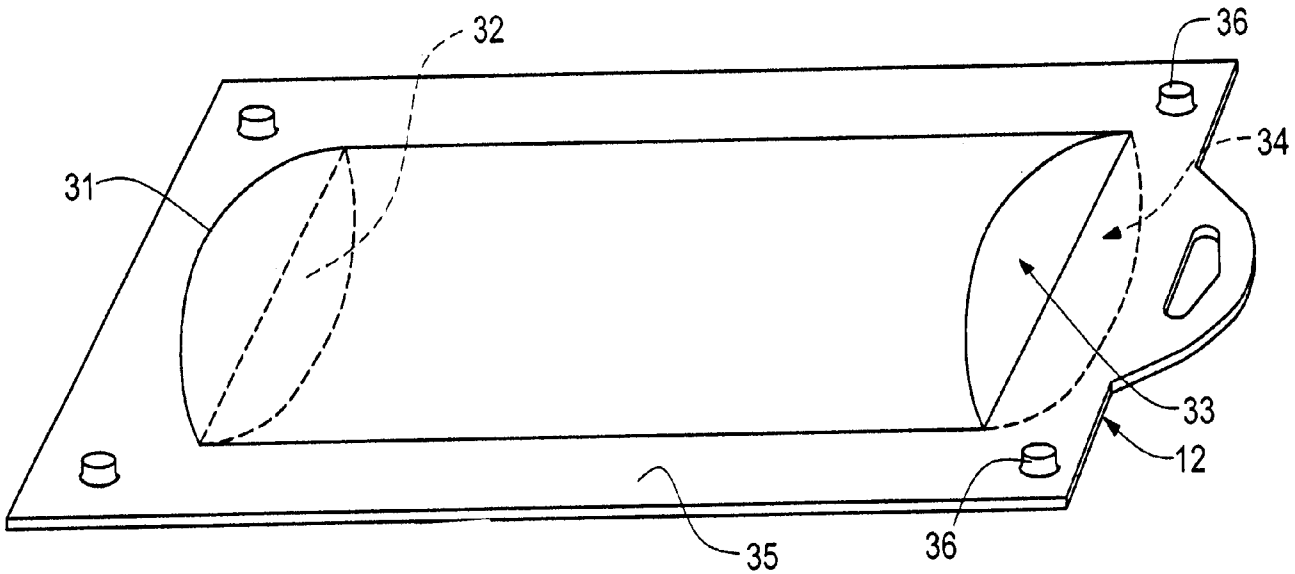
FIG. 2 is a perspective view of an outer package included in the package assembly.
Figure 4:
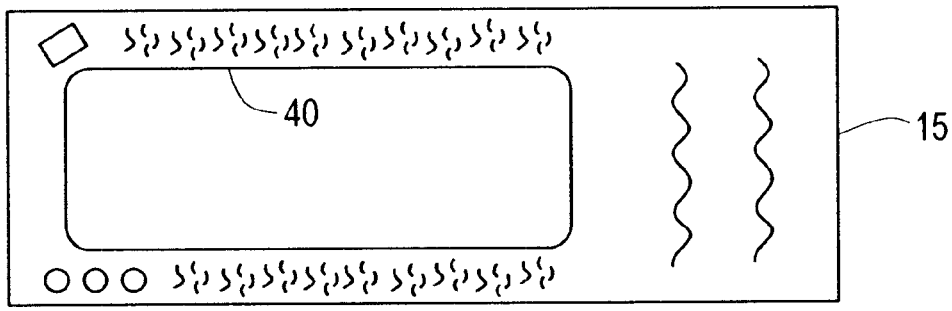
Figure 5:
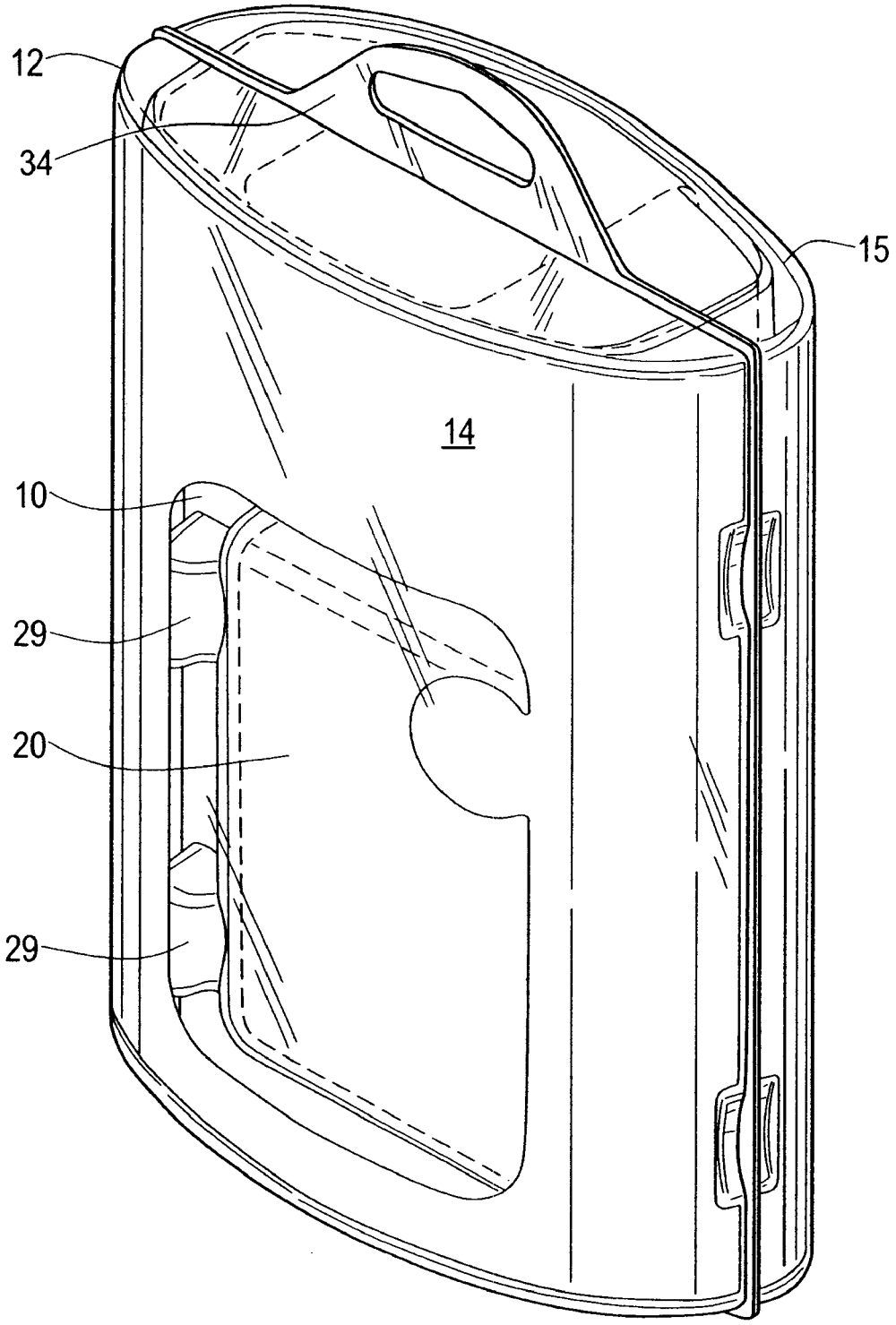
FIG. 5 is a perspective view of the package assembly including the inner and outer packages of FIGS. 1 and 2 respectively; the information sheets of FIGS. 3 and 4 and a product located in the inner package.

Referring to the drawings in detail there is shown in FIG. 5 for illustrative purposes only a package assembly constituting a preferred embodiment of the present invention. The assembly includes an inner package generally designated 10 in FIG. 1, and an outer package generally designate 12 in FIG. 2 and one or more information sheets, two being shown as 14 and 15 in FIGS. 3 and 4. The inner package 10 includes one or more compartments, for housing a product. In the preferred embodiment shown, the inner package 10 includes three compartments 20, 22, and 24, which may house a product such as a camera and its accessories such as a strap and photographic film, or any other accessories. Of course, the package assembly may house products other than cameras. In the preferred embodiment, the inner package 10 includes two identical parts 25 and 26 each including a peripheral flange 27 and one or more compartments shown as 20, 22 and 24 overlying each other to form the compartments receiving the products. In the preferred embodiment the inner package parts 25, 26 are made of one piece sheet plastic and include blister projections and recesses 28 for releaseably recurring the parts together with their compartments 20, 22, 24 in registry with each other as best shown FIG. 1.

The walls of the inner package 10 are provided with transparent portions for overlying the product housed therein. Although in the preferred embodiment, the transparent portions are provided via the transparent plastic material employed to manufacture the inner package 10, they may also be provided by cut-out portions or windows (not shown) in the walls of the inner package to overly the package product. Therefore the term, "transparent" as used herein and in the appended claims includes transparent material or cut-outs or windows provided in the walls of the inner package 10. In the preferred embodiment, the inner package 10 is provided with integral strengthening ribs 29 which serve to support and shape the information sheet and also serve to space the inner package from the walls of the outer package 12 when inserted in the latter.

The outer package 12 is also formed from two identical pieces 31 and 32 molded or stamped in one integral piece from transparent plastic sheet material. The pieces 31 and 32 respectively include semi-elliptical compartments 33 and 34 as defined by semi-elliptical walls projecting outwardly from flat peripheral flanges 35. The pieces 31 and 32 of the outer package 12 can be releasebly secured together in the preferred embodiment by blister 36 formed at the four corner areas of each piece. The pieces 31 and 32 are intended to be RF sealed as well. A projecting blister 36 is received in the passage of the opposite blister; there being two blisters 36 projecting form one side and two from the opposite side of each piece 31 and 32. It will be appreciated that the pieces 31 and 32 can be hingedly connected to one another (not shown) along a common edge.

Figure 3:
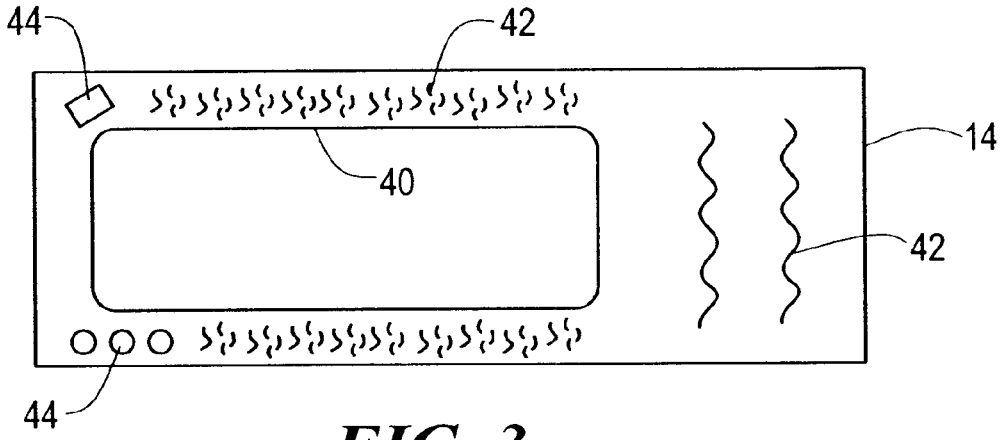
FIGS. 3 and 4 are plan views of information sheets included in the package assembly.

Since the outer package 12 is formed from transparent material, when the inner package 10 is placed in the outer package 12, the product will be visible to the viewer through the walls of the inner and outer packages. Labeling and other information such as trademark and/or instructions for use of the product are also presented to the viewer through the transparent walls of the outer package 12. A pair of information sheets 14 and 15 is shown in FIGS. 3 and 4 and is adapted to be inserted in the outer package against the concave inner wall surfaces of compartments 33 and 34 with the information facing outwardly as best shown in FIG. 5. The information sheets 14, 15 are provided with transparent portions 40 formed by cut-out or window portions formed in the sheets 14, 15. The information on sheets 14, 15 is designated by the materials 42 and 44 in FIG. 3.

In assembling the package assembly, the products are placed into the compartments 20, 22, 24 of one inner package piece 25 or 26. The other piece is then aligned with and secured to the first piece by inserting the blister 28 of one piece into the opposing blister 28 of the other piece. The information sheets 14 and 15 are inserted in the outer package pieces 12 against the concave inner wall surfaces with the information 42, 44 facing outwardly of the pieces. The inner package 10 is then inserted in the compartment of one of the outer package pieces 31 or 32 and the other outer package piece is aligned with and secured to the first piece by inserting transparency of the inner and outer packages 10 and 12 and the cut-out portions 40 of information sheets 14 and 15, the products can be viewed by a consumer or other person without opening the package assembly. The same access for reading the information sheets 14, 15 is also provided without opening the package assembly. At the same time the product is securely held and protected in the package with the minimum of wasted space so that a compact finished package assembly is achieved. In addition, it is far more difficult for someone to steal the product.

Figure 6:
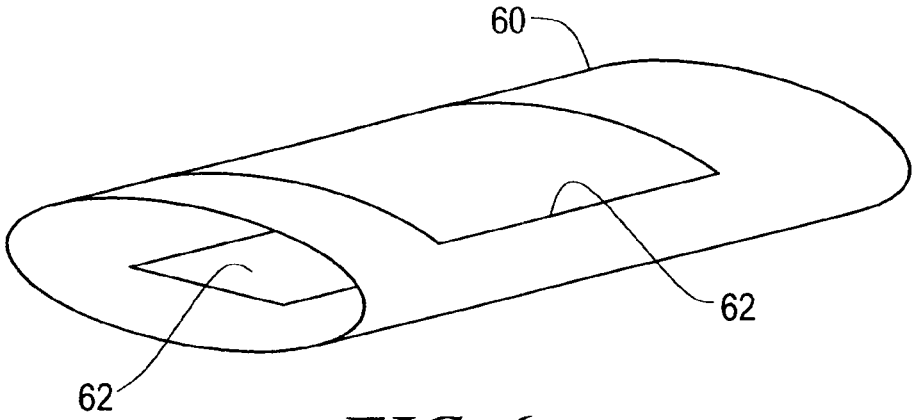
FIG. 6 is a perspective view of a single information sheet for enclosing the inner package assembly.

FIG. 6 illustrates another embodiment of the present invention, wherein an information sheet 60 is provided in a tubular format made from a single sheet of suitable material. The tubular information sheet 60 is advantageous since it is dimensioned to slidably fit over the inner package, thereby eliminating the procedure involved with the use of two sheets. The information sheet 60 is provided with transparent portions 62 formed by cut-out or window portions formed in the sheet 60.

Although a preferred embodiment of the present invention has been shown and described, the modifications of the present invention will become apparent to those of ordinary skill in the art without departing from the spirit and scope of the present invention as defined in the appended claims.

What is claimed is:

1. A package assembly for holding and viewing an article and instruction sheet comprising in combination:

an inner package, having an interior and exterior, comprising two opposed mating parts which, when mated, cooperate to form the inner package and define at least one compartment in the interior of the inner package for receiving and enclosing an article, the at least one compartment having a transparent portion enabling the viewing of an article located therein from the exterior of the inner package:

an outer package having an interior and an exterior and being configured to receive and enclose the inner package having an article therein, the outer package having separate first and second transparent portions, the first transparent portion overlying the transparent portion of the at least one compartment enabling the viewing of the article from the exterior of the outer package; and a tubular information sheet having information thereon and a transparent window spaced from the information, the tubular information sheet being dimensioned to slidably fit over the inner package with the window in alignment with the transparent portion of the at least one compartment so that the information sheet is disposed within the outer package, between the interior of the outer package and the exterior of the inner package, with the transparent window of the sheet in alignment with the first transparent portion of the outer package and the information on the sheet in alignment with the second transparent portion of the outer package enabling the viewing of the information on the sheet through the second transparent portion from the exterior of the outer package, thereby enabling the viewing of both the article and the information on the sheet without having to open the package assembly.

2. The package assembly of claim 1 wherein the inner package is provided with integral strengthening ribs extending outwardly on the exterior of the inner package so as to engage the tubular information sheet fitted over the inner package thereby serving to support and shape the information sheet.

3. The package assembly of claim 2 wherein the strengthening ribs also serve to space the inner package from the interior walls of the outer package when the inner package is inserted in the outer package.

4. A method of packaging an article and an instruction sheet comprising the steps of:

providing an inner package, having an interior and exterior, comprising two opposed mating parts which, when mated, cooperate to form the inner package and define at least one compartment in the interior of the inner package for receiving and enclosing an article, the at least one compartment having a transparent portion enabling the viewing of an article located therein from the exterior of the inner package;

providing an outer package having an interior and an exterior and being configured to receive and enclose the inner package having an article therein, the outer package having separate first and second transparent portions;

providing a tubular information sheet having information thereon and a transparent window spaced from the information, the tubular information sheet being dimensioned to slidably fit over the inner package with the window in alignment with the transparent portion of the at least one compartment;

inserting the article into the at least one compartment and closing the inner package;

slidably fitting the tubular information sheet over the closed inner package with the window in alignment with the transparent portion of the at least one compartment; and inserting the inner package with the tubular information sheet thereon into the interior of the outer package so that the information sheet is disposed within the outer package, between the interior of the outer package and the interior of the inner package, with the transparent window of the sheet in alignment with the first transparent portion of the outer package and the information on the sheet in alignment with the second transparent portion of the outer package enabling the viewing of the information on the sheet through the second transparent portion of the outer package thereby enabling the viewing of both the article and the information on the sheet without having to open the package assembly.

5. The method of claim 4 further including the step of providing the inner package with strengthening ribs on the exterior thereof which engage the tubular information sheet serving to support and shape the information sheet and also serving to space the inner package from interior walls of the outer package when the inner package is inserted in the outer package.

* * * * *